United States Patent [19]

Shino et al.

[11] 3,968,543

[45] July 13, 1976

[54] ROTARY DRAFTING APPARATUS

[75] Inventors: Masakazu Shino, Yamato-takada; Toshio Tange, Nagoya; Shigekazu Ueda; Masashi Kobayashi, both of Kasugai, all of Japan

[73] Assignees: Chubu Seiko Kabushiki Kaisha, Kasugai; Masakazu Shino, Yamato-takada, both of Japan

[22] Filed: July 3, 1974

[21] Appl. No.: 485,760

[30] Foreign Application Priority Data

July 6, 1973 Japan ..... 48-80989[U]
July 6, 1973 Japan ..... 48-80990[U]

[52] U.S. Cl. ..... 19/293; 19/258
[51] Int. Cl.[2] ..... D01H 5/24
[58] Field of Search ..... 19/236, 258, 293, 106 A, 19/105, 260, 246, 247

[56] References Cited

UNITED STATES PATENTS

| | | | |
|---|---|---|---|
| 2,761,179 | 9/1956 | Lepoutre | 19/258 |
| 3,248,902 | 5/1966 | Radtke | 19/105 X |
| 3,611,507 | 10/1971 | Ootsuki et al. | 19/258 X |
| 3,715,780 | 2/1973 | Chaikin et al. | 19/128 |
| 3,748,695 | 7/1973 | Shino et al. | 19/258 |
| 3,858,278 | 1/1975 | Schmitt et al. | 19/260 |

FOREIGN PATENTS OR APPLICATIONS

| | | | |
|---|---|---|---|
| 968,980 | 5/1950 | France | 19/293 |
| 301,624 | 12/1928 | United Kingdom | 19/293 |
| 1,131,320 | 10/1968 | United Kingdom | 19/106 A |

*Primary Examiner*—Dorsey Newton
*Attorney, Agent, or Firm*—Haseltine, Lake & Waters

[57] ABSTRACT

A rotary drafting apparatus for use in a spinning machine, which apparatus comprises a pair of back rollers coactively rotatable for guiding therethrough sliver to be drafted, and a pair of front rollers coactively rotatable for drafting the guided sliver. A sliver control mechanism is interposed between the back rollers and the front rollers and includes plural pairs of control rollers, which are rotatably supported through their respective support shafts and which are formed with numerous needles, so that the guided sliver may be combed when it is passed therethrough. A rotation regulating mechanism is also incorporated in the drafting apparatus so as to regulate rotation of that pair of the control rollers, which is positioned closer to the front rollers, substantially at a predetermined constant angular velocity in a manner to be free from being affected by any possible variation in the drafting force of the front rollers, thereby minimizing unevenness in thickness of the sliver obtainable.

2 Claims, 5 Drawing Figures

ROTARY DRAFTING APPARATUS

BACKGROUND OF THE INVENTION

1. Field of the Invention:

The present invention relates generally to a rotary drafting apparatus for use in a spinning machine, and more particularly to a rotary drafting apparatus of the type in which a rotary gill or chain gill has its sliver control members made always rotatable at a predetermined angular velocity.

2. Description of the Prior Art:

A chain gill, a rotary gill or the like is conventionally usable in a rotary drafting apparatus. Since the sliver control members are used in the rotary drafting apparatus, for instance, chains or control rollers are usually driven by a gear mechanism, they will be rotated temporarily at an angular velocity excessively higher than a predetermined level as a result of sudden increase in the drafting force of the front rollers owing to the condition of the sliver and the like. Thus, the conventional drafting apparatus has a disadvantage that the spinned sliver obtainable has a non-uniform or uneven thickness.

In this connection, the rotary drafting apparatus of the inventors, as disclosed in Japanese Patent Publication No. 67-6016, could accomplish the combing treatment of the sliver more efficiently and uniformly than the prior-art apparatus. However, the unevenness in the thickness of the sliver could not be completely eliminated even by this apparatus.

We, have studied the causes for the formation of uneven sliver, and discovered that the unevenness comes mainly from the fact that the sliver control members closer to the front rollers are caused to undergo, as a result of temporarily excessive drafting force of the front rollers, correspondingly increased angular velocity excessively higher than a predetermined level which is regulated by the driving mechanism. In the conventional drafting apparatus, the driving force from a prime mover is usually transmitted to the back gears, which are coaxially secured to the back rollers, by way of a reduction gear mechanism, and then to the front rollers by way of several intermediate gears and coacting gears which are coaxially secured to control members such as the control rollers. In the power transmission gear mechanism of this kind, however, the accumulation of the clearances or backlashes of the associated gears are so great that they are rotated temporarily at an excessive angular velocity by the temporarily excessive drafting force of the front rollers. This excessive rotation is a major cause for the unevenness in the obtained sliver.

SUMMARY OF THE INVENTION

It is therefore, an object of the present invention to provide a rotary drafting apparatus in which the above drawbacks are eliminated.

According to a major aspect of the present invention, there is provided a rotary drafting apparatus for use in a spinning machine, which apparatus comprises: a pair of back rollers coactively rotatable for guiding therethrough sliver to be drafted; a pair of front rollers coactively rotatable for drafting the guided sliver; sliver control means interposed between the back rollers and the front rollers and including plural pairs of control rollers, which are rotatably supported through their respective support shafts and which are formed with a multiplicity of needles, for combing the guided sliver when it is passed therethrough; and drive means for effecting rotation of that pair of the control rollers, which is positioned closer to the front rollers, substantially at a predetermined constant angular velocity in a manner to be free from being affected by any possible variation in the drafting force of the front rollers, thereby minimizing unevenness of the sliver obtainable.

BRIEF DESCRIPTION OF THE DRAWINGS

Other objects and advantages of the present invention will now be apparent from the following description taken in conjunction with the accompanying drawings, in which.

DESCRIPTION OF THE PREFERRED EMBODIMENTS

Figure 1:
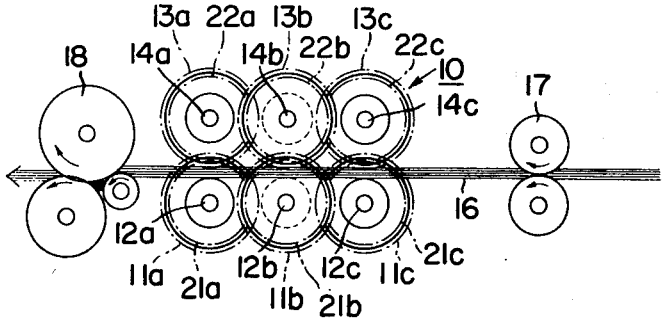
FIG. 1 is a simplified side elevational view illustrating the power transmission relations between the paired control rollers to be used in a rotary drafting apparatus according to the present invention.

One embodiment of the present invention will now be described in conjunction with a drafting apparatus, which is equipped with a sliver control mechanism as generally indicated at reference numeral 10 in the accompanying drawings.

Figure 2:
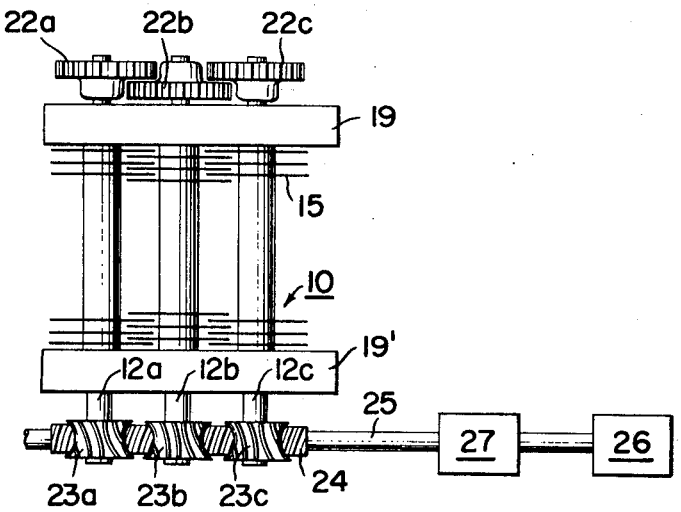
FIG. 2 is a top plan view showing an essential portion of a rotary drafting apparatus exemplifying the present invention.
Figure 3:
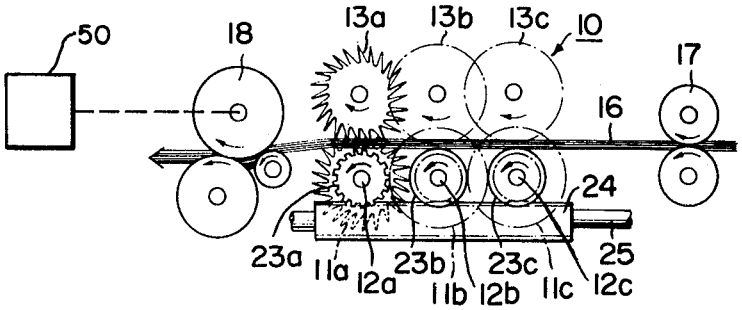
FIG. 3 is similar to FIG. 1 but showing the essential portion of the rotary drafting apparatus of FIG. 2.

In FIGS. 1, 2 and 3, indicated at reference numeral 11*a*, 11*b* and 11*c* are bottom control rollers which are supported through respective support shafts 12*a*, 12*b* and 12*c*. Likewise, indicated at reference numerals 13*a*, 13*b* and 13*c* are top control rollers which are also supported through respective support shafts 14*a*, 14*b* and 14*c*. On the circumferential surface of these rollers, there are integrally formed a multiplicity of needles 15 or the like, by which sliver 16 coming from a pair of back rollers 17 are combed while it is advanced toward a pair of front rollers 18. The respective support shafts of the top and bottom control rollers have their both ends rotatably supported by stationary stands 19 and 19', as better shown in FIG. 2. A gear mechanism is attached to one end portion of the shafts of the control rollers. To the other end portion is attached a driving mechanism which acts to drive the gear mechanism and accordingly to rotate the control rollers coactively. As is apparent from FIG. 1, the gear mechanism is composed of plural pairs of gears 21*a*, 21*b* and 21*c*, which are secured to the respective shafts of the bottom control rollers, and of coacting gears 22*a*, 22*b* and 22*c* which are secured to the respective shafts of the top control rollers. The paired gears 21*a* and 22*a*, 21*b* and 22*b*, and 21*c* and 22*c* are arranged to mesh with each other.

To the other ends of the respective shafts 12*a*, 12*b* and 12*c* of the bottom control rollers, are secured worm wheels 23*a*, 23*b* and 23*c*, which are arranged perpendicularly to the particular shafts and have their one end secured to the same in a manner to rotate therewith. These worm wheels are made to mesh with a worm 24, which is secured to an input shaft 25 linked to a prime mover 26 by way of a suitable reduction mechanism 27.

When the primer mover 26 starts, its driving force will be transmitted to the reduction mechanism 27 and to the input shaft 25, in this order, to drive both the worm 24, which is secured to the input shaft 25, and the worm wheels 23*a* to 23*c* which mesh therewith. As a result, the bottom control rollers 11*a* to 11*c* and accordingly the gears 21*a* to 21*c* are rotated, so that their coacting gears 22*a* to 22*c* are rotated with the resultant rotations of the coaxial top control rollers 13*a* to 13*c*.

According to the present invention having the construction as described, possible irregular rotations of the control rollers can be obviated, even if the front rollers 18, which are driven by a suitable driving mechanism 50 at a circumferential velocity several times those of the control rollers, should exert an irregular drafting force, i.e., an irregular drawing force upon the sliver 16. As has been described beforehand, the control rollers of the conventional drafting apparatus will rotate to an excessive extent temporarily with the increase in the drafting force, but their rotations will be accomplished at an angular velocity equal to or lower than a predetermined level with the decrease in the drafting force, thus inviting the uneven thickness of the sliver. Since, however, the control rollers in the present invention are rotated by the mechanism using the combination of the worm and the worm wheels, the possible change in the drafting force of the front rollers will never lead to deviation of the angular velocity of the control rollers from a predetermined constant level. It follows that the uneven thickness of the sliver, which might otherwise take place in the portion of the sliver advance, can be almost completely eliminated. Since, moreover, the front rollers are rotating, in operation, at an angular velocity several times those of the control rollers, the teeth both of the worm and the worm wheels are at all times shifted angularly in the direction to be drawn by the advancing sliver so that the undesirable irregularity in the angular velocity can be obviated, even if there are considerable clearances between those teeth.

Figure 4:
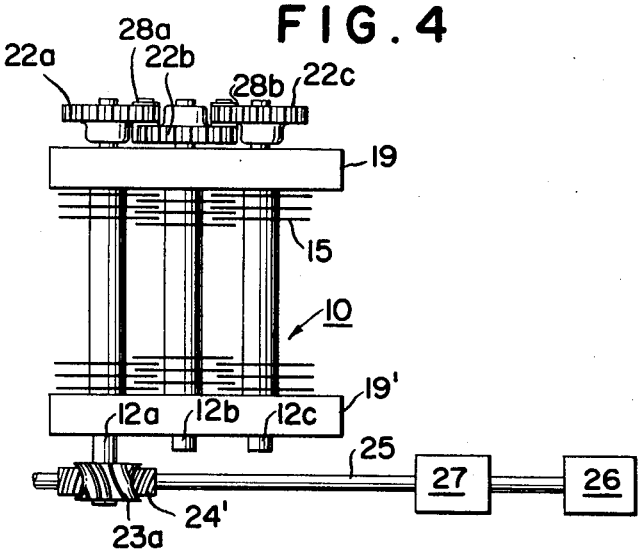
FIG. 4 is similar to FIG. 2 but shows another embodiment of the present invention.

Another simplified embodiment of the present invention will be described with reference to FIG. 4, in which like numerals will indicate like elements or parts of the rotary drafting apparatus. Thus, their repeated explanation will be omitted except for the drive mechanism. According to the basic concept of the present invention, it is sufficient for the purpose of minimizing unevenness of the sliver, if rotation of that pair of the control rollers, which is positioned closer to the front rollers, is substantially at a predetermined constant angular velocity. Thus, the worm wheels 23*b* and 23*c* of the first embodiment can be omitted in a manner to be free from being affected by any possible variation in the drafting force of the front rollers. As shown in FIG. 4, the driving force of the prime mover 26 is transmitted only to the single worm wheel 23*a* in mesh with a worm 24' by way of the reduction mechanism 27 and the input shaft 25. For power transmitting purposes, intermediate gears 28*a* and 28*b* are interposed between the adjacent gears 21*a*, 21*b* and 21*c* in meshing engagement therewith. Thus, the driving force is transmitted from the bottom control roller 11*a* to the other control rollers 11*b* and 11*c* without the worm wheels 23*b* and 23*c*.

EXAMPLE

The second embodiment was used in the worsted fore-spinning No. 2 process, the unevenness in thickness of the sliver was measured with use of the "Uster" evenness tester. It was confirmed from the test that the unevenness in thickness was reduced from the conventional value of 2.0 to 2.6% to a value of 1.7 to 1.8%, and that such reduction was obtained irrespective of change in the spinning conditions, such as, the kind of fiber. Thus, it can be said that the rotary drafting apparatus according to the present invention has the feature of enhanced stability in the drafting performance.

Figure 5:
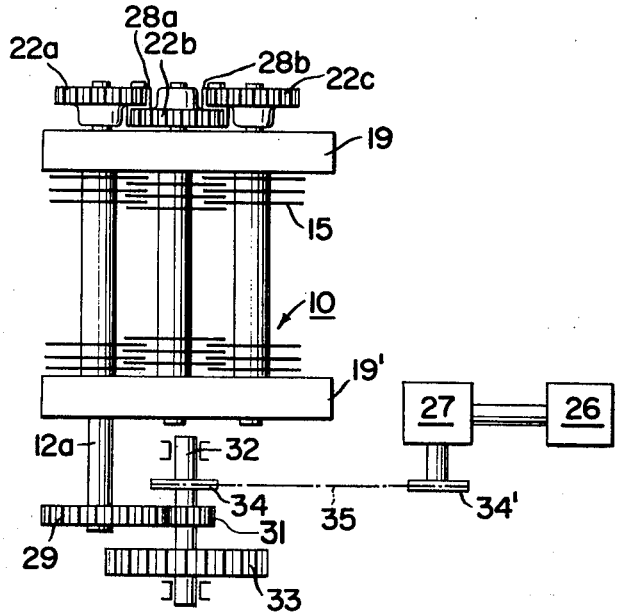
FIG. 5 is also similar to FIG. 2 but shows still another embodiment of the present invention.

Turning now to FIG. 5, still another embodiment of the present invention will be described, but the repeated explanation of similarly numbered elements or parts will be omitted. In this embodiment, the rotation regulating mechanism incorporates a spur gear 29 secured to one end of the shaft 12*a* of the bottom control roller 11*a*, a spur gear 31 meshing with the gear 29, a support shaft 32 supporting the gear 31 in a rotatable manner therewith, a fly wheel 33 secured to the shaft 32 and having a sufficient inertia, and a pulley or gear secured to the shaft 32. Thus, the driving force from the prime mover 26 is applied through the reduction mechanism 27 first to the shaft 32 by the use of a suitable mechanism, such as, gear 34 and 34' and a chain 35. The driving force is then transmitted to the gear 29 secured to the bottom control roller 11*a*. Thus, the other control rollers 11*b* and 11*c* are rotated at a predetermined constant angular velocity by the action of the gear mechanism including the intermediate gears 28*a* and 28*b*. In this embodiment, moreover, the fly wheel 33 is attached to the shaft 32, which is first driven by the prime mover but is supported independently of other shafts. As a result, the gear ratio between the gears 29 and 31 may be so preset as to offer a high inertia of rotation. According to the basic concept of the invention, however, the fly wheel 33 can be secured directly to the shaft 12*a* of the bottom control roller 11*a*, dispensing with the gear 31 and the shaft 32.

Generally speaking, since the control rollers in a rotary gill have a relatively low speed of rotation, such as, 30 to 100 rpm, the inertia of rotation of the control rollers themselves is considerably small. In the third embodiment, however, since the fly wheel 33 is disposed at such a position to allow a relatively fast rotation, the resultant inertia of rotation of the rotation regulating mechanism can be made so high as to absorb the variation, if any, in the drafting force of the front rollers. Thus, the angular velocity of rotation of the control rollers can be kept substantially at a constant level, and the unevenness in thickness of the sliver can be eliminated almost completely.

Although the foregoing description has been given for drafting apparatus equipped with control rollers, the present invention should not be limited to those three embodiments.

What is claimed is:

1. A rotary drafting apparatus for a spinning machine, comprising a pair of back rollers coactively rotatable for guiding therethrough, a sliver to be drafted, a pair of front rollers coactively rotatable for drafting the guided sliver, drive means for the front rollers, a sliver control means interposed between said back rollers and said front rollers and including a plurality of pairs of rotatable control rollers with respective rotatable support shafts, said shafts being arranged in spaced relation between the front and back rollers, a plurality of needles on said support shafts for combing the sliver passing through the sliver control means, and second drive means for that pair of control rollers lying closest to said front rollers for imparting thereto a predetermined substantially constant angular velocity irrespective of any variation in the tension of the sliver between the front rollers and said control rollers, said second drive means including a worm wheel secured to one end of said shaft of said closest pair of said control rollers, a prime mover, and a worm driven by said prime mover substantially at a predetermined constant velocity and meshing with said worm wheel for rotating one corresponding roller of said closest pair of said predetermined constant angular velocity.

2. A rotary drafting apparatus according to claim 1, further comprising at least one worm wheel secured to one end of one shaft of the remaining pairs of said control rollers, and at least one worm coaxially secured to the first said worm and meshing with the second worm wheel for rotating one corresponding roller of said remaining pairs at said predetermined constant angular velocity.

* * * * *